United States Patent [19]

Elsener

[11] Patent Number: 4,837,932

[45] Date of Patent: Jun. 13, 1989

[54] LOCKING BLADE POCKET-KNIFE

[75] Inventor: Carl Elsener, Ibach-Schwyz, Switzerland

[73] Assignee: Victorinox AG, Ibach, Switzerland

[21] Appl. No.: 890,860

[22] Filed: Jul. 28, 1986

[30] Foreign Application Priority Data

Aug. 6, 1985 [DE] Fed. Rep. of Germany ..... 3528105
May 30, 1986 [CH] Switzerland ..... 2182/86

[51] Int. Cl.[4] ..... B26B 3/06
[52] U.S. Cl. ..... 30/161; 30/159
[58] Field of Search ..... 30/161, 162, 159, 160

[56] References Cited

U.S. PATENT DOCUMENTS

| | | | |
|---|---|---|---|
| 924,070 | 6/1909 | Holman . | |
| 1,743,022 | 1/1930 | Carman | 30/161 |
| 1,852,400 | 4/1932 | Champlin | 30/161 |
| 2,728,984 | 1/1956 | Hopta | 30/161 |
| 4,006,514 | 2/1977 | Penman | 30/161 X |
| 4,040,181 | 8/1977 | Johnson | 30/161 |
| 4,302,877 | 12/1981 | Hart et al. | 30/161 |
| 4,535,539 | 8/1985 | Friedman et al. | 30/161 |

FOREIGN PATENT DOCUMENTS

| | | |
|---|---|---|
| 1715228 | 5/1955 | Fed. Rep. of Germany . |
| 3324627 | 2/1984 | Fed. Rep. of Germany . |

*Primary Examiner*—Frank T. Yost
*Assistant Examiner*—Willmon Fridie, Jr.
*Attorney, Agent, or Firm*—Marmorek, Guttman & Rubenstein

[57] ABSTRACT

A pocket-knife having a blade which is pivotable between open and closed positions, and which is lockable in the open position, is disclosed. The pocket-knife comprises a handle, a knife blade pivotaly mounted at one end of the handle, a beam spring extending substantially along the length of the handle, and a locking device for locking the knife blade in the open position. The beam spring is pivotally mounted for limited rocking movement within the handle. The beam spring includes a recess for receiving a retractable locking member of the locking device, a projection or ratchet tooth cooperating with the locking member, and cam guide cooperating with a tang portion of the knife blade to control the pivoting of the knife blade. When the knife blade is in its extended position, a spring urges the locking member into the recess of the beam spring. The projection on the beam spring abuts against the locking member, thereby preventing the rocking movement of the beam spring and retraction of the blade until the locking member is removed from the recess.

13 Claims, 2 Drawing Sheets

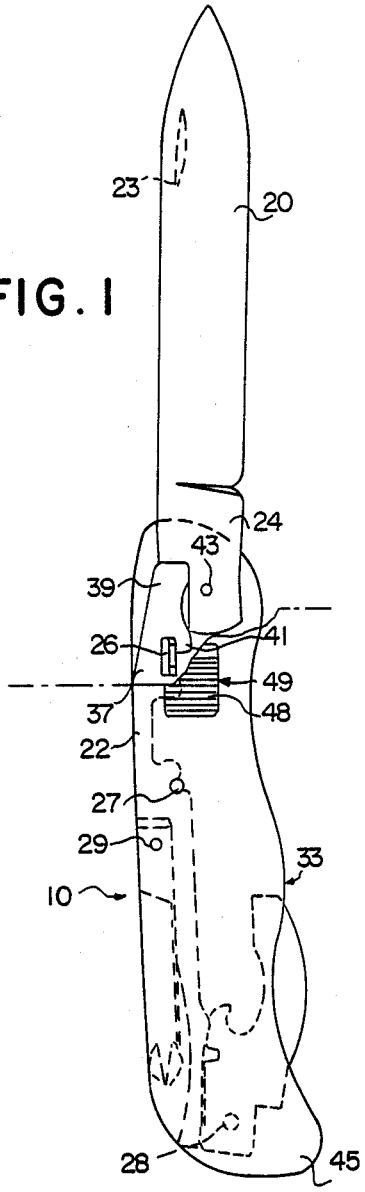
FIG. 1
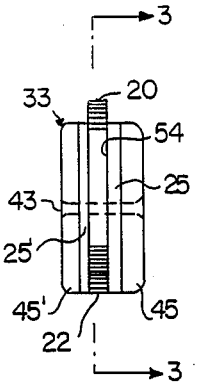
FIG. 2
FIG. 6
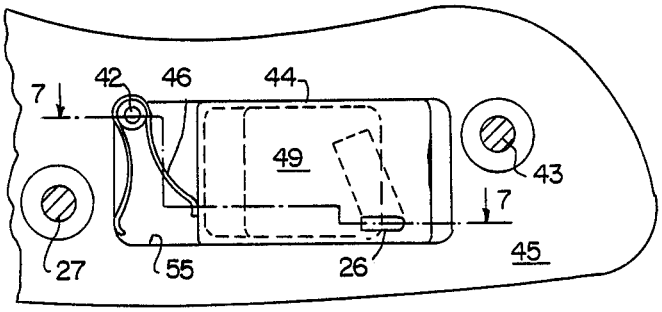
FIG. 7
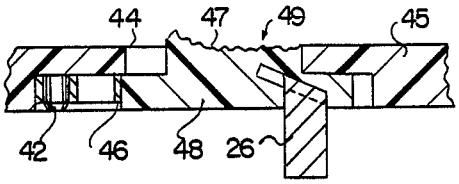

LOCKING BLADE POCKET-KNIFE

BACKGROUND OF THE INVENTION

1. Field of the Invention

This invention relates to a knife of the folding blade type suitable for carrying in a pocket or handbag. In particular, this invention relates to such pocket-knife which is constructed so as to lock the blade in extended or open position for greater safety in use, to minimize any injuries to the hands and fingers of the user when the blade is folded into the handle in closed position, and to minimize damage to the clothing when it is folded and carried in the pocket.

2. Description of the Prior Art

Pocket-knives having foldable locking blades are known in the prior art. Such knives have been made and used for many years and numerous designs have been proposed for accomplishing positive locking of the blade and for easier locking and unlocking of the blade. Generally pocket-knives having a foldable blade do not have a locking mechanism for locking the blade in an extended position. On the other hand, locking mechanisms are known for locking the blade in closed position to be held safely closed in the handle by a beam spring.

The knife disclosed in U.S. Pat. No. 4,040,181 to Johnson shows a locking rocker arm arranged in the back of the handle. The arm is slidingly mounted for movement in the handle. Yet to swing the blade into closed position, a person must change the position of the knife in his hand and further must use both hands in order to press down the rocker arm in the back and then swing the blade in the front of the handle and back between the side covers.

Reference is also made to the U.S. Pat. No. 924,070 to Holman. This construction has a blade pivoted in a handle on a butt pin. When the blade is turned into open position, a guard is folded into the handle and comes into contact with the butt of the blade and holds it. A catch is provided to slide in the handle to engage the guard for firm seating.

German utility model DE-GM No. 17 15 228 shows a pocket-knife with a locking blade provided with a pawl arranged in a side cover to lock the blade in extended position by means of an end pin and a coil spring to urge the blade into locking position. As the blade is pulled out of the handle or returned between the side covers, the user must not change the position of the knife in his hands. The principal disadvantage of this prior art design is that the blade has resilient means for returning the blade to the safe position upon closing. The blade can swing out and may hurt the person and cut the clothing.

Another example of the prior art is a design which relates to a pocket-knife having a locking mechanism that must be released in the open and the closed position of the blade —the latter being unconventional for most knife users. As a result, many users break fingernails when attempting to open the locked blade for use.

Reference is lastly made to another defect of some prior art designs wherein the operating parts of the locking mechanism are open to the exterior. When such knives are used by outdoorsmen, for example, campers, hunters and fishermen, debris, such as sand and wood chips, quickly work in between the parts, including the spring components, and interfere with proper operation. The gaps are usually small and inaccessible so that it is very difficult to clean them.

SUMMARY OF THE INVENTION

It is therefore one of the principal objects of the invention to provide a pocket-knife having a foldable blade which is positively locked and retained in its work position and is returned to its normally closed position following release of the locking mechanism by a person's thumb. Thus, while the knife is held in one hand, the other hand unlocks and swings the blade closed into retracted position, with only a slight expenditure of effort being required.

It is a further object of the invention to provide a pocket-knife having a blade which conforms to the contour of the handle when in the retracted position.

It is a further object of the invention to provide a pocket-knife having a beam spring which yieldingly urges the blade inside the handle, but with the blade's sharp edge out of contact with the beam spring, thus presenting the neat and uncluttered look of a conventional non-locking pocket-knife.

A further object of the invention is to provide a pocket-knife which has a minimum number of components, a totally enclosed spring-locking mechanism, and no protruding parts which can hurt the person or damage clothing.

It is another object to avoid the aforementioned drawbacks of the prior art designs.

Further objects and advantages of the invention will be set forth in part in the following specification and in part will be obvious therefrom without being specifically referred to.

These and other objects of the invention are achieved by means of the locking blade pocket-knife of the present invention, comprising a handle, a knife blade received within the handle, the blade being pivotally mounted at an end of the handle for movement between an extended and a retracted position, spring means mounted within the handle and acting on the knife blade, and locking means cooperating with the spring means to lock the knife blade in the extended position, the locking means including a locking member movable between a locking and an unlocking position, and biasing means urging the locking member into the locking position when the knife blade is in its extended position.

In a preferred embodiment, the spring means comprises a beam spring pivotally mounted within the handle for limited rocking movement about a center point. In this embodiment, the beam spring includes a recess for receiving the locking member and a projection which abuts against the locking member when it is in its locking position, thus preventing the rocking movement of the beam spring and retraction of the blade from its extended position.

In a further preferred embodiment of the invention, the knife blade includes a tang portion having cam means which cooperates with a cam guide on the beam spring to control the pivotal movement of the knife blade.

BRIEF DESCRIPTION OF THE DRAWINGS

For a more complete understanding of the nature and objects of the invention, reference should be made to the following detailed description, taken in connection with the accompanying drawings, in which:

FIG. 1 is a side elevational view of the complete knife, partly broken away, with the blade in extended position;

FIG. 2 is an end elevational view of the knife looking at the forward end;

FIG. 6 is a partial sectional view taken along line 3—3 of FIG. 2 showing details of the locking mechanism;

FIG. 7 is a view of a pawl with slide and key utilized in the locking mechanism.

DETAILED DESCRIPTION OF THE PREFERRED EMBODIMENT

Figure 8:
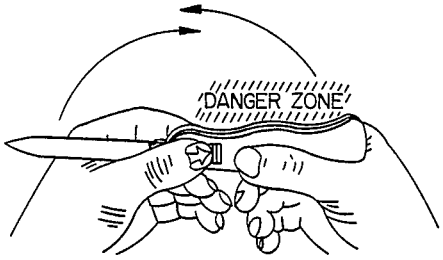
FIG. 8 is a view of the complete knife with the blade in extended position showing proper handling of the knife and blade when releasing the locking mechanism prior to retracting the blade.

Referring now to the drawings, in particular FIGS. 1 and 2, the complete knife 10 with the blade 20 in extended position is illustrated in FIG. 1, in which handle 33 is provided with side covers 45 and linings 25 held in position by a center pin 27 and by fore and aft end pins 43 and 28. Fore and aft bolsters (not shown) may be provided for the side covers 45. The blade 20 has a tang 24 apertured for pivotal mounting on fore end pin 43, and a beam spring 22 which is apertured for pivotal mounting on center pin 27. Any number of linings and blades or tools, e.g., screwdriver 52 or cork screw 51, may be provided depending on the type of pocket-knife furnished.

In FIG. 2 it is seen that a pair of linings 25 and 25′ are arranged in parallel spaced relation to provide a narrow long channel 54. The linings 25 and 25′ are secured in a fixed relation by the center pin 27 and the end pins 28, 43. Beam spring 22 is pivotally mounted on center pin 27 and is located in channel 54. Beam spring 22 is of substantially uniform thickness from end to end and the thickness is such that it has a snug sliding fit between the inner faces of the linings 25 so as to exclude sand, chips, or other debris from the interior of the handle 33 and the working parts to be described.

Figure 3:
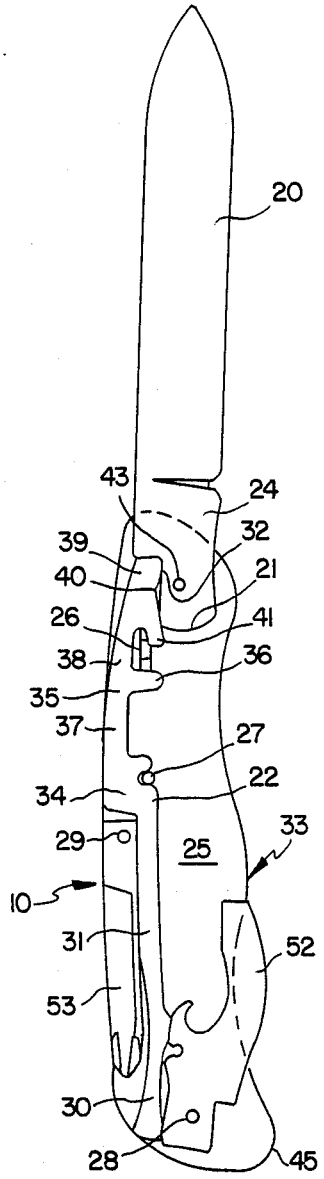
FIG. 3 is a sectional view taken along line 3—3 of FIG. 2 of the complete knife with the blade in extended or open position and the locking mechanism engaged.
Figure 4:
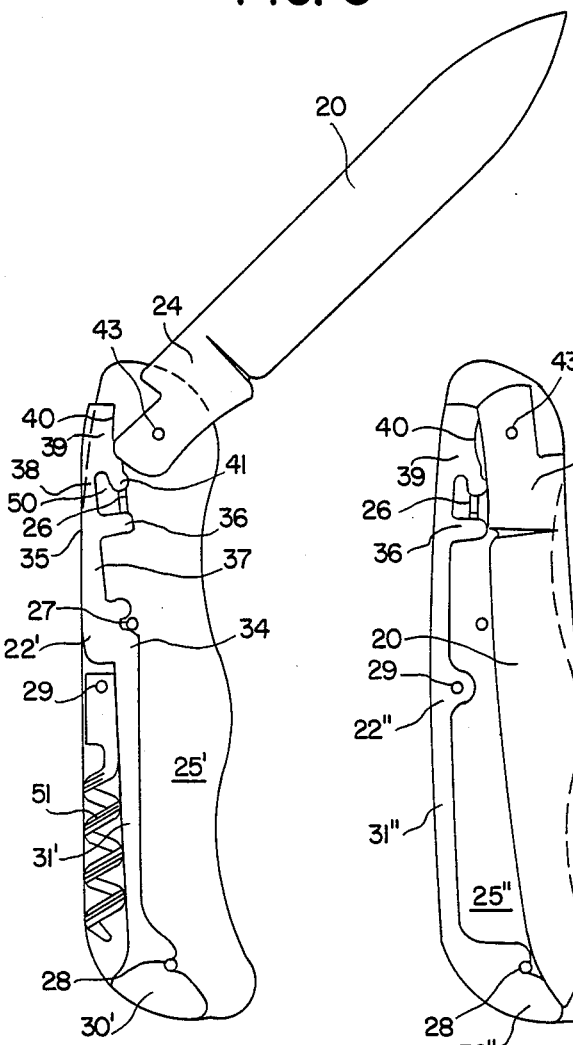
FIG. 4 is a view similar to FIG. 3 but with the blade partially retracted.
Figure 5:
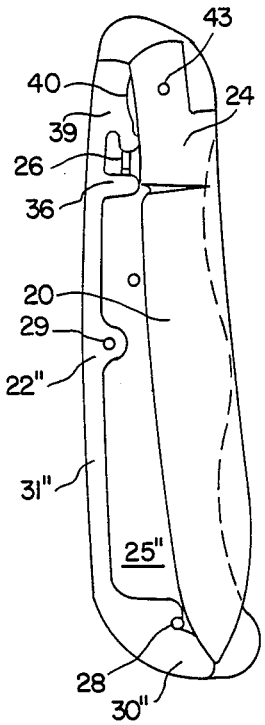
FIG. 5 is a view similar to FIG. 3 but with the blade in retracted or closed position.

With further reference to the drawings, the knife is shown in FIGS. 3, 4 and 5 with one lining 25 and one side cover 45 on one side removed, and with the blade 20 in extended, partially retracted, and retracted position, respectively. A tang 24 is formed with a cam 21 and a kick 32. The fore end 39 of the beam spring 22 is formed with a key aperture 50 and with a ratchet tooth 41 to engage a pawl key 26 of a pawl 49 when the blade 20 is fully extended. As see in FIG. 3 the pawl key 26 fits snugly against the ratchet tooth 41 of beam spring 22. This prevents yielding movement of fore end 39 of beam spring 22 preventing rotation of blade 20 when the blade 20 is fully extended. Thus the blade 20 cannot be accidentally closed in the absence of material failure, and the knife 10 is as safe for use as a fixed blade knife.

The pawl key 26 in one embodiment of the invention may have a cross section of 1/16 inch width and 1/32 inch depth. The beam spring 22 is made of rigid material and thus acts as a spring and a locking beam. Aft portion 31 of beam spring 22 is movably mounted between pivotal pin 29 of phillips screw driver 53 and aft end pin 28 of screw driver 52, and is provided with a recess to produce a spring biasing action to the right and toward center pin 27 which serves as an abutment for the beam spring 22. Also the center pin 27 is located forward of the transverse centerline of the handle 33 to further increase the locking leverage. Cork screw 51 and phillips screw driver 53 are apertured for pivotal mounting on pin 29 and are dimensioned and mounted so that when each is rotated 90° relative to the beam spring 22, the foot end of each is substantially retained in that work position. All four pins 27, 28, 29, 43 protrude with their heads past the outside surfaces of the two outermost linings 25 and 25′. Said pins 27, 28, 29, 43 have collars (not shown) mounted at their respective ends to provide alignment and fastening of upper and lower side covers 45.

FIGS. 3, 4, and 5 illustrate three different embodiments of the beam spring, identified by the numerals 22, 22′, and 22″, respectively. Each of these beam springs has an aft portion 31, 31′, and 31″ in substantial contact with linings 25 and 25′. The aft portions 31, 31′, and 31″ act in combination with aft ends 30, 30′, and 30″ to provide a biasing spring action against the cam of each of the tools 51, 52 and 53 and to maintain each of the tools in extended or closed position between the linings 25 and 25′.

If no tool is provided, the aft portion 31″ is formed with aft end 30″ as shown in FIG. 5. Aft portion 31″ is movably mounted between pins 29 and 28 to facilitate pressing the aft portion 31″ to the right and inwardly of the linings 25 and 25′. Beam spring 22 with its recess is pivotally mounted on center pin 27. Adjacent the recess of beam spring 22, the aft portion 31 is in the general form of a knee 34 to serve as a base end for the fore portion 35 of beam spring 22. The fore portion 35 is formed with a lower section 37, an upper section 38, and a buffer 36 between the two sections 37 and 38 so that the buffer 36 contacts the tang 24 to hold the blade 20 in retracted position in the channel 54 but with the blade's sharp edge out of contact with beam spring 22. See FIG. 5.

The material thickness of lower section 37 is somewhat heavier than that of upper section 38 and must be determined by test or experience for any given model of pocket-knife. Fore portion 35 of beam spring 22 has a fore end 39 and a cam guide 40 formed in fore end 39 for pressing against the cam 21 of tang 24 to slow down the opening or closing movement of the blade 20. The kick 32 of tang 24 cooperates with cam guide 40 to hold the blade 20 in extended and retracted position.

Means must be provided to produce a spring biasing action to hold the pawl 49 and pawl key 26 in locking position. Referring to FIGS. 6 and 7, for this purpose the fore portion of the upper side cover 45 is formed with an aperture 44 having a peripheral wall 55. A slide 48 of pawl 49 fits into aperture 44. Since the slide 48 has a snug sliding fit with two parallel partial walls of peripheral wall 55, the upper lining 25 and the peripheral wall 55 cooperate to produce a totally enclosed pocket which excludes all types of debris. The aperture 44 is in the general form of a long rectangle with its longer side parallel to the back of the handle 33. An arrester pin 42 is fastened in the side cover 45 and also close to one wall of the rectangle to serve as an abutment for the spring 46.

Biasing spring 46 is loosely mounted in the pocket. It may take any of various forms such as a coil spring or a leaf spring engaging arrester pin 42 and peripheral wall 55 in a manner to urge the slide 48 of the pawl 49 upward (FIG. 1). Preferably, the illustrated spring 46 is used. Spring 46 is a leaf spring bent into a V-shape or hair-pin shape as shown with its acute end arcuately formed to partially wrap around arrester pin 42 as an anchorage. One free end is arcuately formed to define a protuberance to engage the peripheral wall 55, and the other free end is arcuately formed to engage the slide 48. The spring 46 thus applies its biasing force to the slide 48 adjacent to its free end to obtain maximum push. Slide 48 and pawl key 26 may be of unitary design, the pawl key being of metal and the slide being of plastic material. A ribbed surface 47 is formed in the outside portion of the side 48 to facilitate pushing the slide 48 of pawl 49 forwardly with ease of finger contact.

OPERATION

The pocket-knife of the invention operates as follows:

The user grasps the handle 33 with either his right or left hand when the blade 20 is in retracted position as seen in FIG. 5. In this position, the beam spring 22" yieldingly urges the aft portion of tang 24 outwardly, and hence the forward portion inwardly, so that the end of the cam 21 and the kick 32 of the tang 24 are engaged to hold the blade 20 in the channel 54 with the sharp edge out of contact with beam spring 22. As the blade 20 is pulled out of the channel 54 using the thumb and index finger of the free hand on the blade 20 and the thumbnail in the nail notch 23, the cam 21 pushes against cam guide 40 and fore portion 35 of beam spring 22. When the blade 20 reaches the fully extended position, spring 46 forces pawl 49 with pawl key 26 into position with ratchet tooth 41 and the blade 20 is locked, as seen in FIG. 3.

To unlock the mechanism for retracting the blade 20, the thumb of the free hand is applied to the pawl 49 in the direction of the arrow in FIG. 8 and moved into the end position in the aperture 44. This compresses the spring 46 and pawl key 26 slides out of locking position with ratchet tooth 41 to release the beam spring 22, thus freeing the blade 20 to swing it into 45° position, rotating fore portion 35 outward, as seen in FIG. 4. Toward the end of the closing movement, at about 25° off the closed blade position, fore portion 35 of beam spring 22 yieldingly urges the blade 20 into retracted position between the linings 25 and side covers 45 of the handle 33.

The beam spring 22 is dimensioned and mounted so that when it is in locking or non-locking position with the blade 20 fully extended or fully retracted, its outer edge is substantially flush with the back of the handle 33, and practically continues to the aft end, around the back and down to the front. The beam spring 22 is also designed and adapted to exert a predetermined force onto the tang 24 keeping the blade 20 safely in closed position, but permitting the blade 20 to be pulled out of channel 54 while avoiding breakage of fingernails.

This locking mechanism may be modified within the scope of the invention to facilitate the locking of other blades or tools of the pocket knife, e.g., a screw driver, a cork screw, a wood saw, a file, etc.

ADVANTAGES

Many advantages of the pocket-knife of the invention have already been referred to herein. It may be useful, however, to mention one major advantage, namely the neat uncluttered appearance it provides similar to that of a conventional nonlocking pocket-knife. The pocket-knife of this invention also presents no gaps or projections in the handle to catch dirt or clothing, or to scratch the hands of a user.

As the specification and illustration in the drawings refer to and set forth only one embodiment of the invention, it is observed that the same may be modified within the scope of the appended claims, without departing from the spirit and scope of the invention.

Having thus described the invention, what I claim as new and desire to be secured by Letters Patent is as follows:

1. A locking blade pocket-knife, comprising a handle;

a knife blade received within said handle, said knife blade being pivotally mounted at an end of said handle for movement between an extended and a retracted position, said knife blade including a tang portion and cam means, a beam spring pivotally mounted within said handle for limited rocking movement, said beam spring including an aperture, a projection partially enclosing said aperture, and a cam guide adjacent said projection, said cam means and cam guide cooperating to control pivotal movement of said knife blade, said cam means traveling along cam guide and causing said beam spring to rock when said knife blade is pivoted, a pawl key movable between a locking position in said aperture and an unlocked position outside of said aperture, biasing means urging said pawl key into locking position when said knife is in its extended position, said projection engaging said pawl key to prevent rocking movement of said beam spring and travel of said cam means along said cam guide and thereby to prevent retraction of said knife blade when said pawl key is in its locking position, and a pawl mounted in said handle for manual sliding movement, said pawl being connected to said pawl key whereby movement of said pawl disengages said pawl key from said projection.

2. The pocket-knife of claim 1 wherein said beam spring includes fore and aft portions, said beam spring being pivotally mounted within said handle for limited rocking movement about a pivot intermediate said fore and aft portions.

3. The pocket-knife of claim 1 wherein said locking means further includes manual actuation means for moving said locking member out of locking position.

4. The pocket-knife of claim 3 wherein said beam spring extends substantially along the back of said handle.

5. The pocket-knife of claim 4 wherein said handle includes a pair of inner linings, said linings defining a longitudinal channel within said handle, said knife blade and said beam spring being received within said channel.

6. The pocket-knife of claim 5 wherein said fore portion of said beam spring includes buffer means, said buffer means abutting against said tang portion of said knife blade when said knife blade is in said retracted position to prevent contact between a sharp edge of said knife blade and said beam spring.

7. The pocket-knife of claim 6 further comprising a fore end pin, a center pin, and an aft end pin within said handle.

8. The pocket-knife of claim 1 wherein said pawl key is mounted for movement parallel to a longitudinal axis of said handle, and wherein said pawl key is of rectangular shape, a long side of a pawl key fitting in a gap defined by said projection and a buffer of said beam spring.

9. The pocket-knife of claim 8 wherein said pawl comprises a ribbed slide, said slide extending through the aperture of said handle to the exterior.

10. The pocket-knife of claim 3 wherein said biasing means comprises a compression spring of hair-pin shape.

11. The pocket-knife of claim 3 wherein said biasing means comprises a leaf spring.

12. The pocket-knife of claim 3 further comprising a tool pivotally mounted within said handle for movement between an extended and a retracted position.

13. The pocket-knife of claim 12 wherein said tool includes a tang portion, said beam spring acting on said tang portion to retain said tool in both the extended and retracted positions.

* * * * *